US008590938B2

(12) United States Patent
Blumberg

(10) Patent No.: US 8,590,938 B2
(45) Date of Patent: Nov. 26, 2013

(54) ENVIRONMENTALLY FRIENDLY BINDING OF CALENDARS

(75) Inventor: Murray B. Blumberg, Gauteng (ZA)

(73) Assignee: Slideco NV, Willemstead, Caracoa (NL)

( * ) Notice: Subject to any disclaimer, the term of this patent is extended or adjusted under 35 U.S.C. 154(b) by 274 days.

(21) Appl. No.: 12/332,373

(22) Filed: Dec. 11, 2008

(65) Prior Publication Data

US 2009/0096203 A1 Apr. 16, 2009

Related U.S. Application Data

(63) Continuation-in-part of application No. 11/187,556, filed on Jul. 22, 2005, now Pat. No. 7,780,370.

(60) Provisional application No. 60/592,921, filed on Jul. 30, 2004.

(51) Int. Cl.
*B42D 5/04* (2006.01)

(52) U.S. Cl.
USPC ..... 283/2; 40/107

(58) Field of Classification Search
USPC ..... 283/2
See application file for complete search history.

(56) References Cited

U.S. PATENT DOCUMENTS

| | | | | |
|---|---|---|---|---|
| 1,843,771 | A | 2/1932 | Kline | |
| 1,881,736 | A | 10/1932 | Malvin | |
| 1,906,024 | A | 4/1933 | Todd | |
| 2,074,606 | A | 3/1937 | Elliot | |
| 2,285,447 | A | 6/1942 | Malvin | |
| 2,387,808 | A | 10/1945 | Pruneau et al. | |
| 3,350,045 | A | 10/1967 | Mayers | |
| 3,867,743 | A * | 2/1975 | Corey | 402/14 |
| 4,009,784 | A | 3/1977 | Elias et al. | |
| 4,077,078 | A | 3/1978 | Snellman et al. | |
| 4,595,309 | A | 6/1986 | Chinchar | |
| 4,899,974 | A * | 2/1990 | Wear et al. | 248/467 |
| 5,683,194 | A * | 11/1997 | Emmel et al. | 402/79 |
| 6,042,319 | A | 3/2000 | Hoffman | |
| 6,444,286 | B1 | 9/2002 | MacKenzie | |
| 6,447,196 | B1 * | 9/2002 | Arkwright | 402/8 |

(Continued)

FOREIGN PATENT DOCUMENTS

| | | |
|---|---|---|
| DE | 686982 | 1/1940 |
| DE | 2119747 | 11/1972 |

(Continued)

OTHER PUBLICATIONS

PCT International Search Report, PCT/IB2005/002255, Mar. 2, 2006, 7 pgs.

(Continued)

*Primary Examiner* — Kristina Junge
(74) *Attorney, Agent, or Firm* — Wood, Herron & Evans, LLP

(57) ABSTRACT

An environmentally friendly single sheet calendar is provided, which includes a single sheet of printed material having first and second opposed edges and first and second opposed faces. A non-metallic, biodegradable binder is disposed along the first edge, with the binder including a rigid bar and a securing element for coupling the rigid bar to the first face of the single sheet. The securing element may, for example, include a layer of adhesive for adhesively coupling the rigid bar to the first face. The adhesive may, for example, be heat activatable.

14 Claims, 3 Drawing Sheets

(56) References Cited

U.S. PATENT DOCUMENTS

| | | | | |
|---|---|---|---|---|
| 6,719,475 | B2 * | 4/2004 | Arkwright | 402/8 |
| D522,053 | S | 5/2006 | Gavronsky | |
| 2004/0114989 | A1 | 6/2004 | Gavronsky | |
| 2009/0097945 | A1 * | 4/2009 | Blumberg | 412/8 |

FOREIGN PATENT DOCUMENTS

| | | | |
|---|---|---|---|
| DE | 2503678 | | 5/1976 |
| DE | 2818453 | | 8/1979 |
| DE | 8702515 | | 9/1987 |
| DE | 19815387 | | 7/1999 |
| JP | 2007-228074 | A * | 8/1995 |
| JP | 07228074 | | 8/1995 |
| JP | 2001297507 | | 9/1999 |
| JP | 200172749 | | 3/2001 |
| WO | 2004/016449 | | 2/2004 |
| WO | 2006013448 | | 9/2006 |

OTHER PUBLICATIONS

PCT Written Opinion, PCT/IB2005/002255, Mar. 2, 2006, 7 pgs.

* cited by examiner

ENVIRONMENTALLY FRIENDLY BINDING OF CALENDARS

CROSS-REFERENCE TO RELATED APPLICATIONS

This application is a continuation-in-part of U.S. patent application Ser. No. 11/187,556 filed on Jul. 22, 2005, which claimed the benefit of U.S. Provisional Application Ser. No. 60/592,921, filed Jul. 30, 2004. This application is being filed concurrently with U.S. patent application Ser. No. 12/332,374, titled CALENDAR BINDING APPARATUS AND RELATED METHODS, and which is also a continuation-in-part of U.S. patent application Ser. No. 11/187,556. Each of these prior applications is hereby incorporated by reference in its entirety.

FIELD OF THE INVENTION

This invention is generally related to binding of calendars and, more particularly, to binding of single sheet calendars in an environmentally friendly manner.

BACKGROUND OF THE INVENTION

Wall calendars and similar reference planners and charts are usually attached to a wall by means of a permanent fastener, e.g., a nail or picture hanger, or with an adhesive such as two-sided tape. The hanger mechanism is usually attached to the binding that holds the pages of the calendar together. At the end of any month the calendar has to be changed to the next month. Then, at year end, the consumers are expected to throw the calendars away and buy new ones, making calendars disposable items.

Currently binding strips for calendars are manufactured from metal sheets or other rigid materials. These strips are then attached to the calendars to bind the calendar pages together. The calendar pages are typically some type of paper material. When the calendars are discarded at the end of the year and replaced with new calendars, the old calendars are thrown away with other garbage and then taken to landfills. The paper material typically making up the pages of the calendar biodegrades very quickly compared to the binders that are made of metal or other materials that are either not biodegradable or biodegrade very slowly. Therefore, disposable calendars that are friendlier to the environment and biodegrade quickly are needed.

Further, in binding operations, it is sometimes necessary for binders to be supplied to the binding operation in a consistent orientation, and for the binders to be supplied in a manageable form.

SUMMARY OF THE INVENTION

The invention addresses these and other problems associated with the prior art and existing solutions by providing an environmentally friendly calendar assembly, that utilizes biodegradable materials in the calendar binding and hanger to allow for the entire calendar to biodegrade quickly and not contribute to overflowing landfills or garbage disposal locations.

The invention solves the problem by providing, in one embodiment, an environmentally friendly single sheet calendar that includes a single sheet of printed material having first and second opposed edges and first and second opposed faces. A non-metallic, biodegradable binder is disposed along the first edge, with the binder including a rigid bar and a securing element for coupling the rigid bar to the first face of the single sheet. The securing element may, for example, include a layer of adhesive for adhesively coupling the rigid bar to the first face. The adhesive may, for example, be heat activatable.

The rigid bar may be made of a material that is selected from the group consisting of wood, cardboard, fibrous plant materials, and synthetic plastic materials. The rigid bar may include a generally flat surface that is coupled to the first face of the single sheet and an opposed rounded surface. The rigid bar may have a generally D-shaped cross-sectional profile. The rigid bar may be generally hollow. In a specific embodiment, the calendar includes a recess in the rigid bar, and a hanger in that recess that extends beyond the general perimeter of the rigid bar and the single sheet. The hanger may be adhesively attached to the rigid bar. The hanger may, for example, be made of a material that is selected from the group consisting of fabrics and synthetic plastic materials.

In another embodiment, a stack of binders is provided that includes at least two binders. The stack includes an amount of adhesive positioned between at least two binders for releasably coupling the binders to one another. A separator may be positioned between the binders for providing a space there between. The adhesive may, for example, be heat activatable. The binders may be biodegradable. The adhesive may be positioned adjacent longitudinal ends of the binders.

From the foregoing disclosure and the following more detailed description of various embodiments, those skilled in the art will realize that this invention provides a significant advance in the technology of calendar binding. Particularly significant in this regard is the potential the invention offers for providing calendar binders and a method of attaching the binders that is friendly to the environment. Additional features and advantages of various preferred embodiments will be better understood in view of the detailed description provided below.

BRIEF DESCRIPTION OF THE DRAWINGS

These and further features of this invention will be apparent with reference to the following description and drawings wherein.

Figure 1:
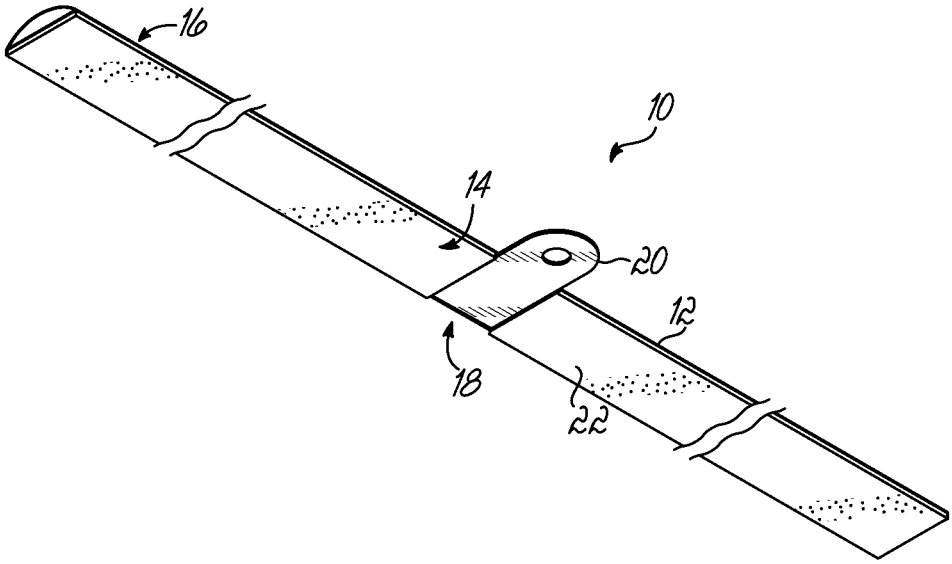
FIG. 1 shows a perspective view from below of a first embodiment of an environmentally friendly binder for a calendar in accordance with the invention.

The appended drawings are not necessarily to scale, presenting a somewhat simplified representation of various features illustrative of the basic principles of the invention. The specific design features of the calendar binders as disclosed herein, including, for example, specific dimensions, orientations, locations, and shapes of various components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION

According to a first aspect of the invention, an environmentally friendly binder for a calendar includes a rigid bar of a suitably biodegradable material and a securing mechanism for securing the bar to a sheet or a stack of sheets. The bar may be of wood, cardboard, other plant material, or a suitable biodegradable synthetic plastic material. The bar may have a hanger attached thereto. The hanger may be of a flexible material and may also be readily biodegradable.

The securing mechanism may be an adhesive. The adhesive may be a pre-applied coating on a surface of the bar. Alternatively, the adhesive may be applied to the bar, or the sheet(s), prior to when the bar is mated with the sheet(s). The securing mechanism may also include a piece of a flexible flat securing material fastened to the bar. The securing material may be fabric or cloth like, and may be natural or artificial materials. The securing material may project from one or both sides of the bar. The piece of securing material may be secured to the sheet(s) forming the calendar by adhesive. As mentioned above, this adhesive could be pre-applied or applied when the calendar sheet(s) is/are being bound. The securing material may be a strip running along the length of the bar or it may be a plurality of tabs projecting from the bar. This securing material may be fastened to the front or rear surface of the bar.

Conveniently, the securing material may be part of a sheet and the tabs may be parts of ribbons. A number of the bars might attach to the sheet or the ribbons, at spaced intervals, and then the sheet or the ribbons might be cut or parted to provide the binder. Thus, a supply of binders may include a plurality of the bars attached at spaced intervals to a length of a flexible flat securing material. The securing material with the bars attached thereto, may be rolled up to provide a roll or reel of the binders and to facilitate separation of the binders when they are parted from the roll or reel.

Further according to an alternative embodiment of the invention, a calendar may have a binder in accordance with the invention. The invention extends to a method of binding a calendar in an environmentally friendly manner, which includes securing the rigid bar of a suitably biodegradable material to a sheet of the calendar. The bar may be adhesively secured to the sheet. In particular, the bar may be fastened with a flexible flat securing material, which is adhesively secure to the calendar sheet. As indicated above, a supply of binders may be provided in reel or roll form and the method may then include cutting or parting the securing material to separate a binder from the roll or reel, and then securing the material to the calendar sheet(s).

Further, as indicated above, adhesive for securing the securing material to the sheet(s) may be pre-applied. In this event, the pre-applied adhesive may be activated by a number of means depending solely on the type of adhesive being used. For example, if the adhesive is heat sensitive, it may be heated just prior to attaching the calendar binder to the calendar sheets. Alternative, the method may include applying the adhesive to the securing material and/or the calendar sheet(s).

The invention extends still further in an alternative embodiment to an apparatus for binding a calendar in an environmentally friendly manner, which includes a mechanism for providing a binder having a rigid bar of a suitably biodegradable material and a securing mechanism for securing the bar to a sheet, or stack of sheets, forming the calendar. The apparatus may have an adhesive activating mechanism for activating a coating of adhesive on the bar or on a piece of a flexible, flat, securing material fast with the bar. Alternative, the apparatus may have an adhesive applicator for applying a layer of adhesive to the bar to the securing material. In the case where the binder has a piece of securing material, the apparatus may have a folding arrangement for folding the securing material over, or around the sheet(s). When the binders are provided in reel or roll form, the apparatus may have a support for the reel or roll and a cutting or parting mechanism for cutting or parting binders from the roll as they are required, and a feeding mechanism for feeding them into mating contact with the sheet(s).

Figure 2:
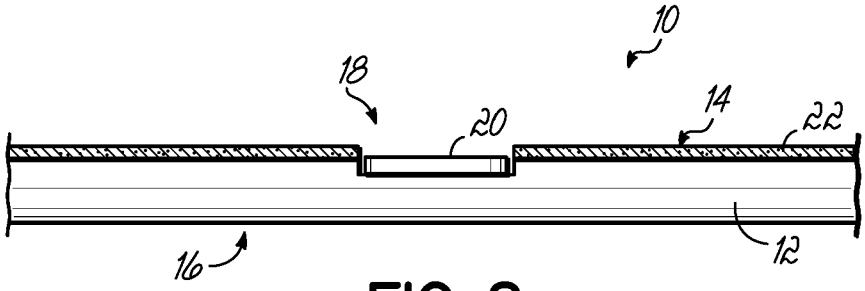
FIG. 2 shows a detailed side view of a central portion of the binder of FIG. 1.

Referring now to FIGS. 1 and 2, a first embodiment of an environmentally friendly binder for a calendar, in accordance with the invention, is designated generally by reference numeral 10. The binder 10 includes a rigid bar 12 of wood, plastic or another non-metal and/or biodegradable material. As shown, the bar 12 has a flat rear surface 14 and a curved front surface 16. For a typical wall calendar the bar might have a length between 15 cm and 92 cm and a width of about 7 mm and a thickness of about 1.5 mm. A recess 18 is centrally positioned on the rear surface 14 of the bar 12 of FIGS. 1-2. A hanger 20 is located in the recess 18 and formed from fabric or a synthetic plastics material. The hanger 20 is glued to the bar 12. A layer 22 of a heat activatable adhesive is included on the rear surface 14 of the bar 12.

Figure 2A:
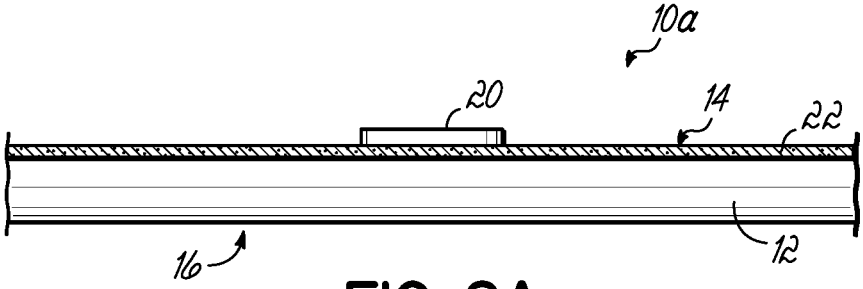
FIG. 2A is a view similar to FIG. 2 of a different embodiment of a binder.

Referring to FIG. 2A, in which like reference numerals refer to like features in FIG. 2, another exemplary embodiment of an environmentally friendly binder for a calendar is generally designated with the numeral 10*a* and is similar to the binder 10 of FIG. 2. Unlike the binder 10, the binder 10*a* of this exemplary embodiment does not have a recess 18 to accommodate the hanger 20. This is facilitated by the relatively thin gauge of the material defining the hanger 20, which does not significantly increase the overall thickness of the binder 10*a*.

Figure 3:
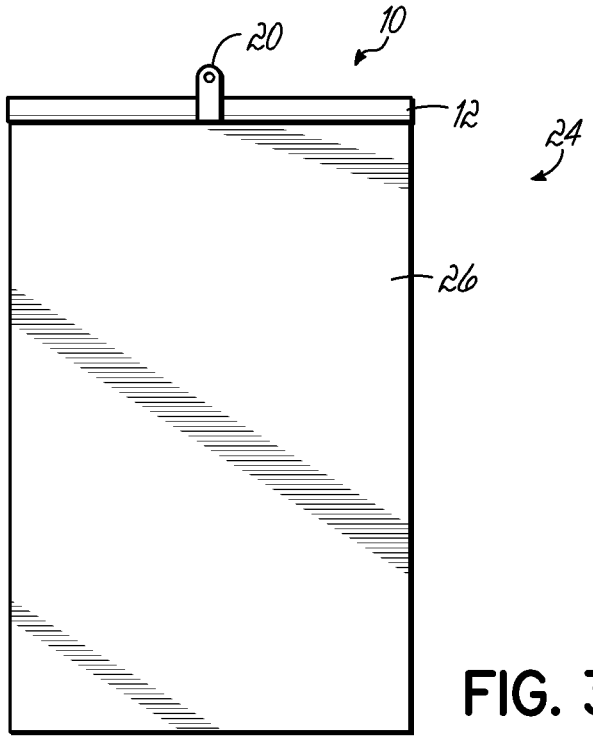
FIG. 3 shows a single sheet calendar bound by the binder of FIG. 1.

In use, with a single sheet calendar 24, such as is shown in FIG. 3, the bar 12 is glued to an upper edge of a sheet of paper or cloth 26, with the hanger 20 projecting therefrom. The binder 10 is bound to the sheet 26 by an apparatus (not shown), which has a magazine containing one or more binders 10 to supply binders positioned into a mating configuration, a heating arrangement for heating the adhesive layer, and a pressure arrangement for pressing the bar 12 against the sheet 26, to adhere it thereto. The heating arrangement may heat the adhesive 22 either before it is mated with the sheet 26, or after.

Figure 4:
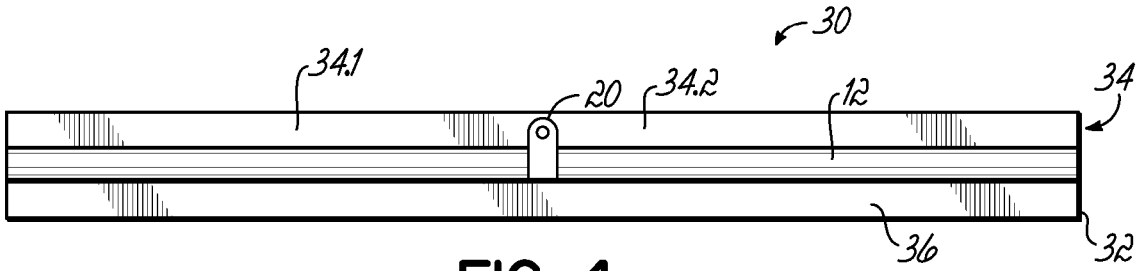
FIG. 4 shows a plan view of a second embodiment of an environmentally friendly binder for a calendar, also in accordance with the invention.
Figure 5:
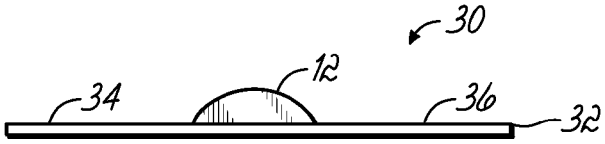
FIG. 5 shows an end, enlarged view of the binder of FIG. 4.

Referring now to FIGS. 4 and 5, a further embodiment of an environmentally friendly binder 30 for a calendar is shown. This binder 30 also has a bar 12 that might be made of wood, plastic or another non-metal and/or biodegradable material. It further has a narrow piece 32 of fabric-like material which is glued to the rear surface of the bar 12, such that there is an upper strip 34 above the bar 12 and a lower strip 36 below the bar 12. The hanger 20 is cut out of the upper strip 34 to provide a left upper strip 34.1 and a right upper strip 34.2.

Figure 6:
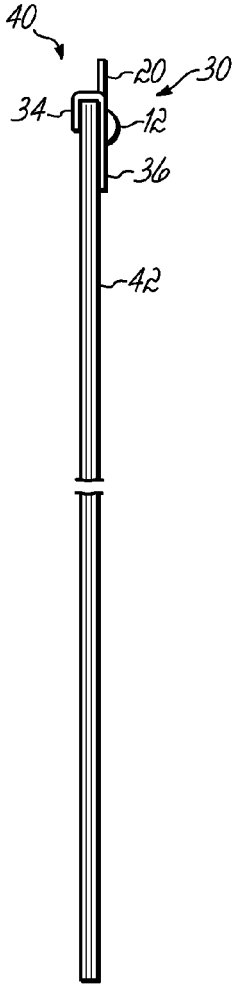
FIG. 6 shows a side view of a multi-sheet calendar bound by the binder of FIG. 4.

In use, as shown in FIG. 6, a multi-sheet calendar 40 has the binder 30 and a bundle 42 of sheets. The binder 30 is secured to the bundle 42 with the bar 12 aligned with a top edge of the bundle 42. The upper left and right strips 34.1 and 34.2, the lower strip 36 and the strip of material underlying the bar 12 are adhered to the bundle 42 by a suitable adhesive. The sheets of the bundle could be pre-secured together by staples, "padding", or the like. As with the earlier example, the adhesive may be pre-applied or applied immediately prior to use.

Figure 7:
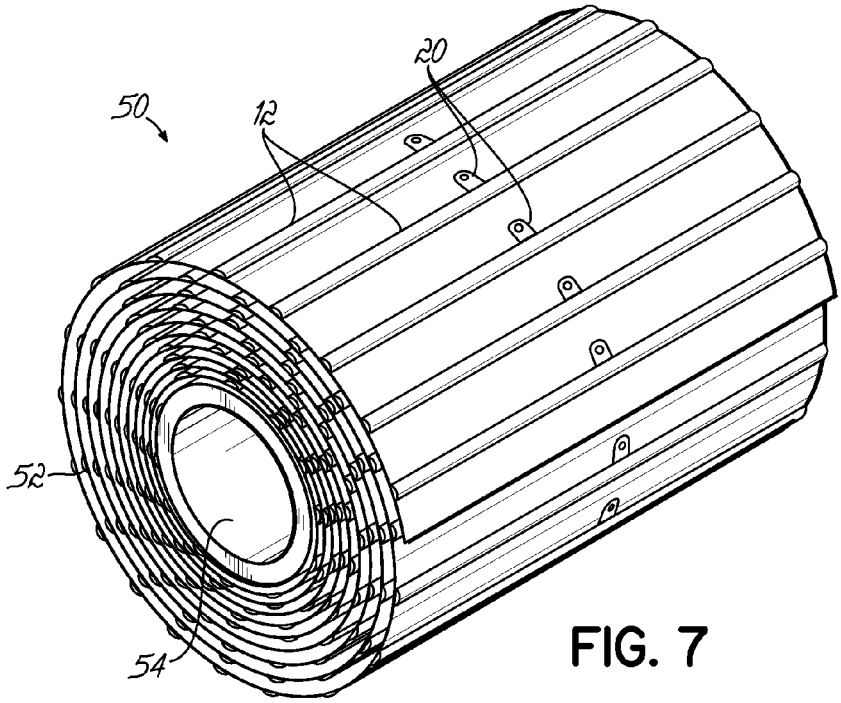
FIG. 7 shows schematically a roll of the binders of FIG. 4.

The binders according to any of the embodiments of this invention may be supplied from a magazine, as with the first embodiment or they may be provided as a roll 50, as shown in FIG. 7. Thus, a sheet 52 of the material is provided with the bars 12 secured thereto at spaced intervals and with hangers 20 cut out of the material. The sheet is then wound on to a core 54. The sheet 52 is then cut appropriately between adjacent bars 12 to provide the binders 30. A parting line could be defined by a line of weakness or perforations so that a binder 30 may be parted from the roll by a parting mechanism, without having to be cut.

Figure 8:
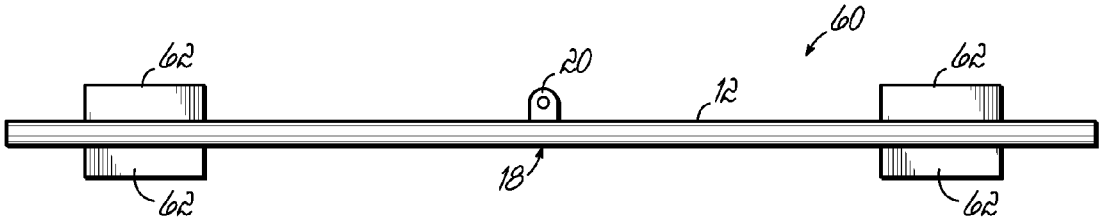
FIG. 8 shows a plan view of a third embodiment of an environmentally friendly binder for a calendar, also in accordance with the invention.

Referring now to FIG. 8, a further embodiment 60 of an environmentally friendly binder in accordance with the invention is shown. This binder 60 is similar in some respects to the binder 10 of FIGS. 1 and 2 in that it has a bar 12 with a hanger 20 in a central recess 18. It is also similar to the binder 30 of FIGS. 4 and 5 in that it has tabs 62 close to both ends and projecting above and below, with the upper tabs 62 being wrapped over a bundle of sheets in the same way as the upper strips 34. The tabs 62 may also be in recesses 18. The exposed portions of the rear surface of the bar 12 and the underneath surfaces of the tabs 62 may be adhesively secured to the sheet(s) forming the calendar. This embodiment may also be supplied in roll form, with the tabs 62 being pieces of ribbons.

Figure 9:
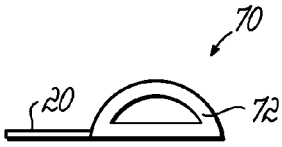
FIG. 9 shows a side view of a fourth embodiment of an environmentally friendly binder for a calendar, also in accordance with the invention.

Referring to FIG. 9, a still further embodiment 70 of an environmentally friendly binder for a calendar is shown. This embodiment 70 has an extruded hollow bar 72 that is made of a readily biodegradable material such as synthetic plastics and a hanger 20. The hollow nature of the bar 72 results in a lower cost and/or lower weight of the binder 70. Further, the extrusion process by which the bar 72 is made permits the color, surface finish and profile of the bar 72 to be achieved in a single step.

Figure 10:
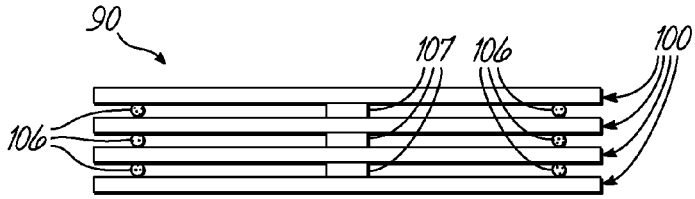
FIG. 10 shows a side view of an embodiment of a stack of calendar binders.

Referring to FIG. 10, an exemplary embodiment of a stack 90 of binders is generally illustrated. For purposes of description, the binders in this embodiment are assigned the numeral 100 and may be similar to any of the binders shown in the preceding figures and discussed in the corresponding descriptions. The stack 90 of binders 100 in this embodiment includes suitably positioned spots or lines 106 of adhesive between adjacent binders 100 to thereby releasably keep the binders 100 in stack form. The stack 90 may include one or more separators 107 disposed between adjacent binders to permit their separation from one another. In this regard, for example, a binder feeding mechanism that retrieves binders 100 from a magazine holding the stack 90 may include a heating element (not shown) that heats the spots or lines of adhesive to thereby permit separation of the adjacent binders 100 in the stack 90.

From the foregoing disclosure and detailed description of certain illustrated embodiments, various modifications, additions, and other alternative embodiments are possible without departing from the true scope and spirit of this invention. For example, the rigid bar can each have many different sizes, materials and shapes to accommodate various types of calendars. The embodiments that are disclosed were chosen and described to provide the best illustration of the principles of this invention and its practical application to thereby enable one of ordinary skill in the art to utilize the invention in various embodiments and with various modifications as are suited to particular uses. All such modifications and variations are within the scope of this invention as determined by the appended claims when interpreted in accordance with the benefit to which they are fairly, legally, and equitably entitled.

What is claimed is:

1. A stack of environmentally-friendly calendar binders, comprising:

at least two non-metallic, biodegradable binders adapted to be coupled to a same number of calendars proximate upper or lower edges of the calendars;

an amount of adhesive positioned between said at least two binders for releasably coupling said binders to one another; and at least one separator positioned between each pair of adjacent binders to permit separation of the adjacent binders from one another;

wherein an outermost binder may be removed from the stack and may be used to construct a calendar assembly;

wherein said amount of adhesive further comprises two discrete spots of adhesive each of which is positioned adjacent one of the longitudinal ends of said binders.

2. The stack of claim 1, wherein each said binder is made of a material selected from the group consisting of wood, cardboard, fibrous plant materials, and synthetic plastic materials.

3. The stack of claim 1, wherein each said binder has a back face which is a generally flat surface and each said binder includes an opposed rounded surface as a front face.

4. The stack of claim 1, wherein each said binder has a generally D-shaped cross-sectional profile.

5. The stack of claim 1, wherein each said binder is generally hollow.

6. The stack of claim 1, further comprising:

a hanger attached to each said binder extending beyond the general perimeter of said binder.

7. The stack of claim 6 further comprising:

a recess in a back face of each said binder wherein said hanger is positioned within said recess.

8. The stack of claim 6, wherein said hanger is adhesively attached to said binder.

9. The stack of claim 6, wherein said hanger is made of a material selected from the group consisting of fabrics and synthetic plastic materials.

10. The stack of claim 1, further comprising:

a pair of tabs respectively positioned proximate the associated longitudinal ends of each said binder.

11. The stack of claim 10, further comprising:

a pair of end recesses on the back face and positioned at the longitudinal ends of the binder, said tabs being respectively positioned within said pair of end recesses.

12. The stack of claim 1, wherein said adhesive is heat activatable.

13. The stack of claim 1, wherein said binders are biodegradable.

14. The stack of claim 1 wherein the at least one separator is positioned longitudinally between and spaced from said two discrete spots of adhesive.

* * * * *